US010024619B2

(12) United States Patent
Almazan et al.

(10) Patent No.: US 10,024,619 B2
(45) Date of Patent: Jul. 17, 2018

(54) TEMPERATURE REDUCTION PROTECTIVE WRAP

(71) Applicants: Gian Almazan, Agoura Hills, CA (US); Hamid R. Akhavan, Calabasas, CA (US); Chris Castro, Calabasas, CA (US)

(72) Inventors: Gian Almazan, Agoura Hills, CA (US); Hamid R. Akhavan, Calabasas, CA (US); Chris Castro, Calabasas, CA (US)

( * ) Notice: Subject to any disclaimer, the term of this patent is extended or adjusted under 35 U.S.C. 154(b) by 0 days.

(21) Appl. No.: 14/856,233

(22) Filed: Sep. 16, 2015

(65) Prior Publication Data

US 2016/0076845 A1 Mar. 17, 2016

Related U.S. Application Data

(60) Provisional application No. 62/051,199, filed on Sep. 16, 2014.

(51) Int. Cl.
*F41A 21/44* (2006.01)

(52) U.S. Cl.
CPC ..... *F41A 21/44* (2013.01)

(58) Field of Classification Search
CPC ..... F41A 21/44; F41A 13/12; F41A 21/24
USPC ..... 42/96
See application file for complete search history.

(56) References Cited

U.S. PATENT DOCUMENTS 1,167,233 A * 1/1916 Warner ..... F41A 21/02 42/76.01
1,736,383 A * 11/1929 Waggoner ..... B65D 65/08 150/154
4,346,643 A * 8/1982 Taylor ..... F41A 21/44 165/104.26
4,762,048 A * 8/1988 Higashi ..... F41A 21/44 165/47
RE32,752 E * 9/1988 Kiang ..... F41H 3/00 206/317
4,896,437 A * 1/1990 Johnson ..... A43B 23/06 2/22
5,005,374 A * 4/1991 Spitler ..... A41D 13/0055 2/171.2
5,062,346 A * 11/1991 Greve Hansen ..... F41A 21/44 89/14.1
5,637,389 A * 6/1997 Colvin ..... A41D 31/0038 2/2.16
5,850,706 A * 12/1998 Evans ..... G02B 27/0006 150/154
6,358,608 B1 * 3/2002 Hanyon ..... A41D 31/0022 428/357
6,800,367 B2 * 10/2004 Hanyon ..... D02G 3/442 428/364
6,986,221 B2 * 1/2006 Mullis ..... F41A 23/02 42/74

(Continued)

OTHER PUBLICATIONS

S Kawabata and R S Rengasamy, Thermal conductibity of unidirectional fibre composites made from yarns and computation of thermal conductivity yarns, Sep. 27, 2002.*

*Primary Examiner* — Joshua E Freeman
(74) *Attorney, Agent, or Firm* — One LLP

(57) ABSTRACT

An approach is presented for a temperature reduction protective wrap that wraps around a barrel of a firearm and protects a user's hand and fingers from being burned.

11 Claims, 5 Drawing Sheets

(56) References Cited

U.S. PATENT DOCUMENTS 7,360,648 B1 * 4/2008 Blaschke ..... F41C 33/06 206/317
7,559,168 B2 * 7/2009 Wisecup ..... F41G 1/383 150/154
7,670,682 B2 * 3/2010 Klett ..... C04B 38/0022 423/447.1
D630,335 S * 1/2011 Wise ..... D24/206
8,141,286 B1 * 3/2012 Saur ..... F41C 23/08 42/74
D673,237 S * 12/2012 Richey, Jr. ..... D22/108
8,935,874 B2 * 1/2015 Troy ..... F41A 35/02 42/90
2003/0060107 A1 * 3/2003 Gooliak ..... B32B 5/02 442/131
2004/0116023 A1 * 6/2004 Huang ..... A61F 13/06 442/328
2006/0083937 A1 * 4/2006 Burd ..... F01D 5/288 428/457
2006/0090748 A1 * 5/2006 White ..... F28F 9/20 126/714
2007/0231573 A1 * 10/2007 Thatcher ..... D02G 3/36 428/375
2008/0053109 A1 * 3/2008 Quincy ..... F25D 5/02 62/4
2009/0209155 A1 * 8/2009 Goulet ..... A41D 31/0027 442/234
2009/0258180 A1 * 10/2009 Goulet ..... A41D 31/0016 428/72
2010/0170135 A1 * 7/2010 Tompkins ..... F41A 35/04 42/96
2011/0023347 A1 * 2/2011 Boggan ..... F41A 35/02 42/96
2011/0100204 A1 * 5/2011 Schlenkert ..... F41A 13/12 89/14.1
2012/0042558 A1 * 2/2012 Brensinger ..... F41A 35/02 42/96
2012/0167435 A1 * 7/2012 Poling ..... F41A 13/12 42/90
2013/0048903 A1 * 2/2013 Garnier ..... B01J 27/22 252/71
2013/0061503 A1 * 3/2013 W ..... F41A 21/44 42/76.01
2015/0260328 A1 * 9/2015 Colcombet ..... F16L 11/082 138/125
2015/0362280 A1 * 12/2015 Dale ..... F41A 35/02 42/96
2016/0076845 A1 * 3/2016 Almazan ..... F41A 21/44 42/96

* cited by examiner

TEMPERATURE REDUCTION PROTECTIVE WRAP

RELATED APPLICATION

This application is relates to and claims priority to U.S. Provisional Application No. 62/051,199 titled TEMPERATURE REDUCTION PROTECTIVE WRAP, filed on Sep. 16, 2014, which is incorporated by reference herein.

FIELD OF THE INVENTION

This application relates to the field of firearms and more particularly to protective wraps place on firearms.

BACKGROUND

Many firearms, such as rifles, have barrels that heat up when discharged. The more rounds discharged through the barrel, the hotter the barrel becomes. This creates a problem for steadying the firearm by gripping the barrel. One approach employed by firearm manufactures has been to place wooden stocks under the barrel that can be gripped. A problem with this approach is that the hot barrel is still exposed and may be touched by a user of the firearm. Further, the wooden stock under the barrel is fixed and is not adjustable. Another approach that has been employed, is wrapping the barrel with a rag or cloth. The problem presented by this approach is the cloth slips on the metal barrel and the cloth does very little to stop the transfer of heat.

Therefore there is a need for an approach and system to protect the user of a firearm from the heat of the barrel while allowing for adjustment of the placement and increasing the ability of the barrel to be gripped.

SUMMARY

An approach that protects a user of a firearm from the heat of a barrel is presented. A temperature reduction protective wrap (TRPW) encompasses a portion of the barrel of a firearm. The TRPW may have a protective layer that slows or prevents the transfer of heat from the firearm barrel to a user who is gripping the TRPW and firearm barrel. The TRPW is secured around the barrel and may be adjusted by un-securing and re-securing the TRPW. An outer layer of the TRPW may include a material to aid in a hand gripping the barrel and another layer may prevent or reduce the transfer of heat to the outer layer.

The above described features and advantages, as well as others, will become more readily apparent to those of ordinary skill in the art by reference to the following detailed description and accompanying drawings. The TRPW disclosed herein extend to those embodiments which fall within the scope of the appended claims, regardless of whether they accomplish one or more of the above-mentioned advantages.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DESCRIPTION

Figure 1:
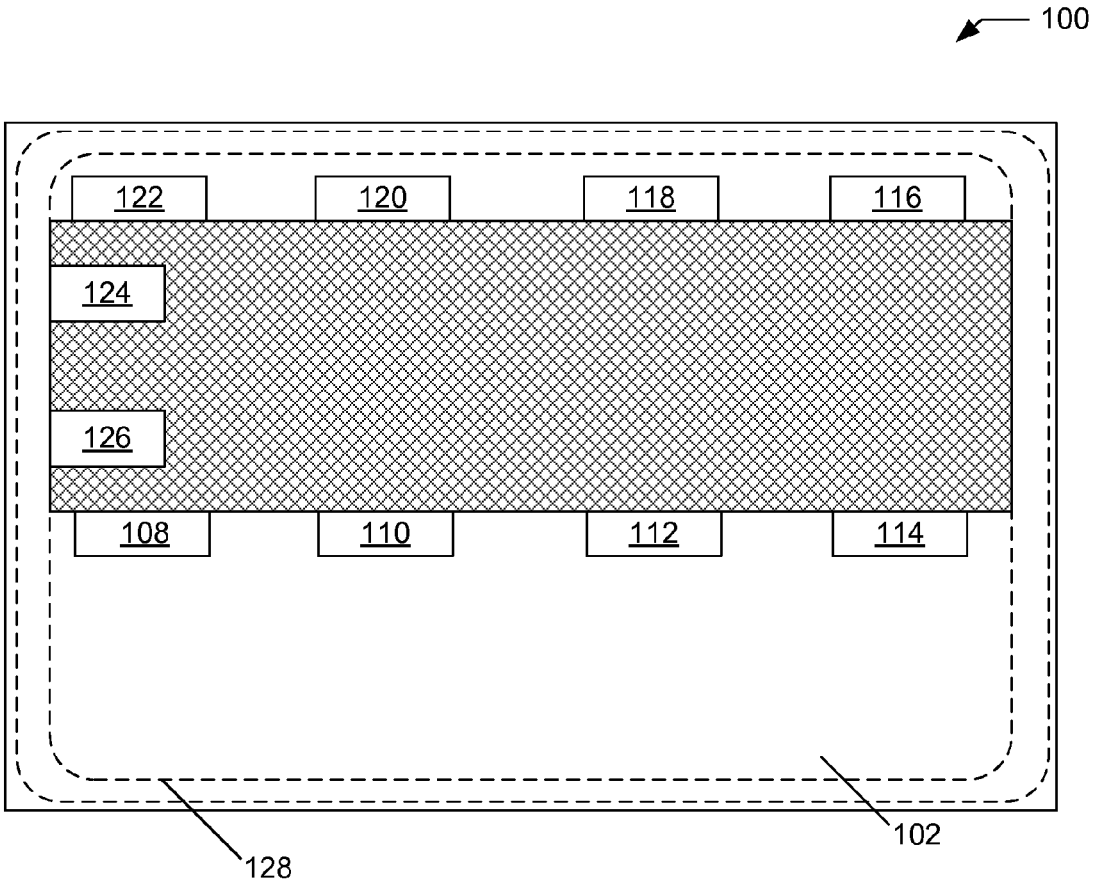
FIG. 1 is an example of a temperature reduction protective wrap (TRPW) prior to securing means being coupled to the TRPW in accordance with an example implementation.
Figure 1:
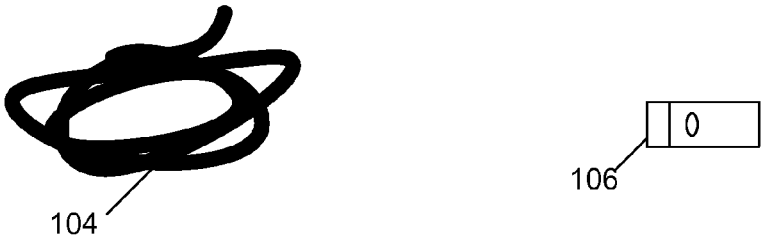

A temperature reduction protective wrap (TRPW) 102 is described that protects a user of a firearm from burning their hand or fingers when aiming and discharging the firearm. In FIG. 1, an example diagram 100 of a TRPW 102 prior to securing means 104 and 106 being coupled to the TRPW 102 in accordance with an example implementation. Securing means 104 is a flexible member, such as a cord, wire, strip of fabric, or similar item capable of being tied. A locking mechanism 106 may be a securing means that locks the securing means 104 such that the securing means 104 stays tight or stressed. The securing means 104 may be passed through loops 108-122 that are spaced apart across the TRPW 102 in parallel pairs. Loops 124 and 126 are perpendicular to loops 108-122 and are placed towards one end of the TRPW 102. Loops 124 and 126 help to hold the securing means 104 in place on the TRPW 102. Without loops 124 and 126, the securing means 104 may be moved by the gripping motion of a person during use of the weapon. In FIG. 1, stitching 128 may also be seen as an approach for holding the parts of the TRPW 102 in place.

The TRPW 102 is depicted in the diagram 100 as being flat. The ability of the TRPW 102 to lie flat prior to installation is a benefit that allows for easy shipment of the TRPW 102. More TRPWs may be placed in a shipping container than if they were round and flat envelopes may be used to mail the TRPWs to consumers. In other implementations other types of shapes for the TRPW 102 may be employed, such as cylindrical. The TRPW 102 may have an outer covering that has a camouflage design. In other implementations, other colors or designs may be employed.

Figure 2:
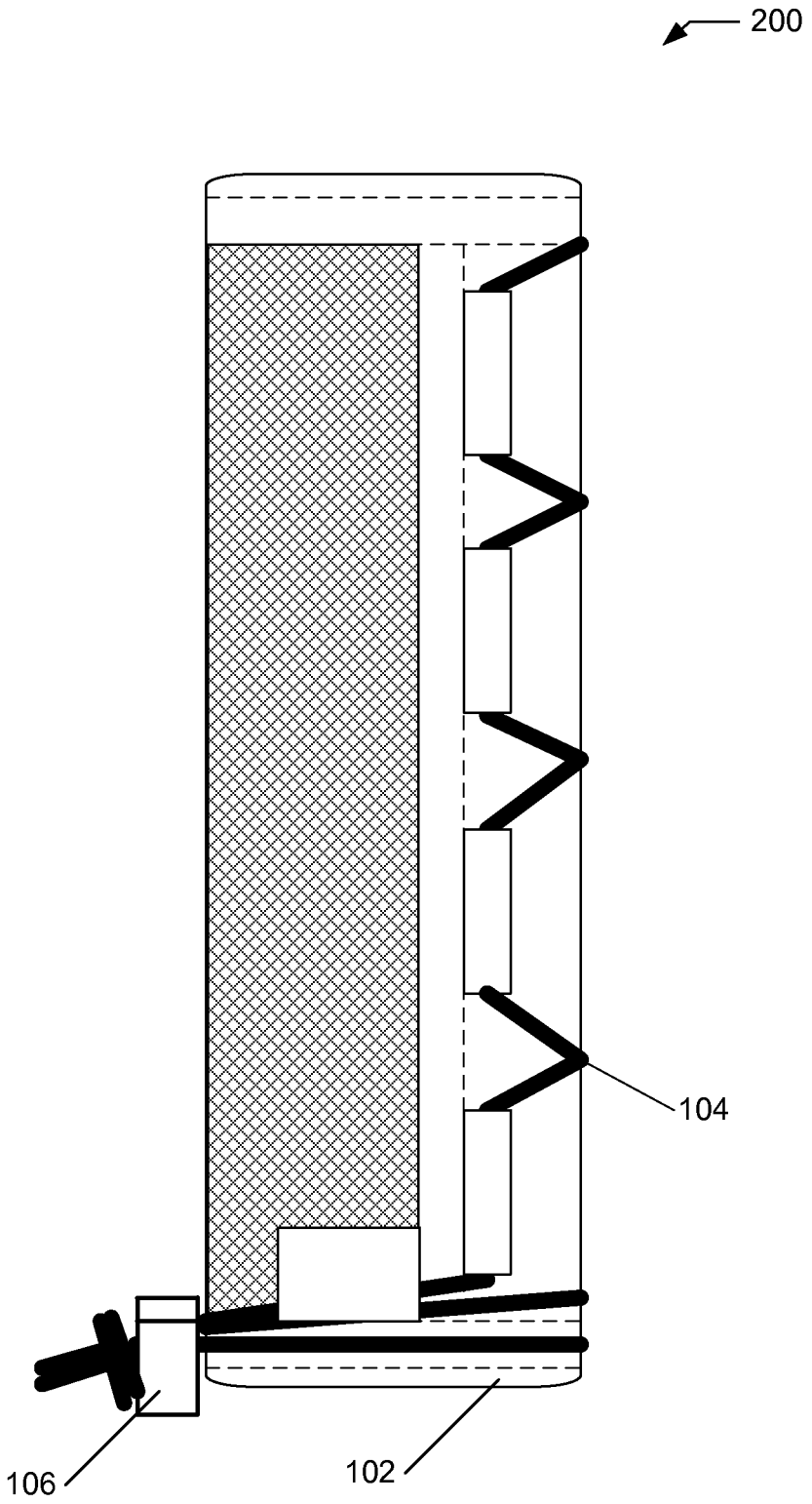
FIG. 2 is a depiction of a TRPW of FIG. 1 with securing means in accordance with an example implementation.
Figures 3A, 3B, 3C:
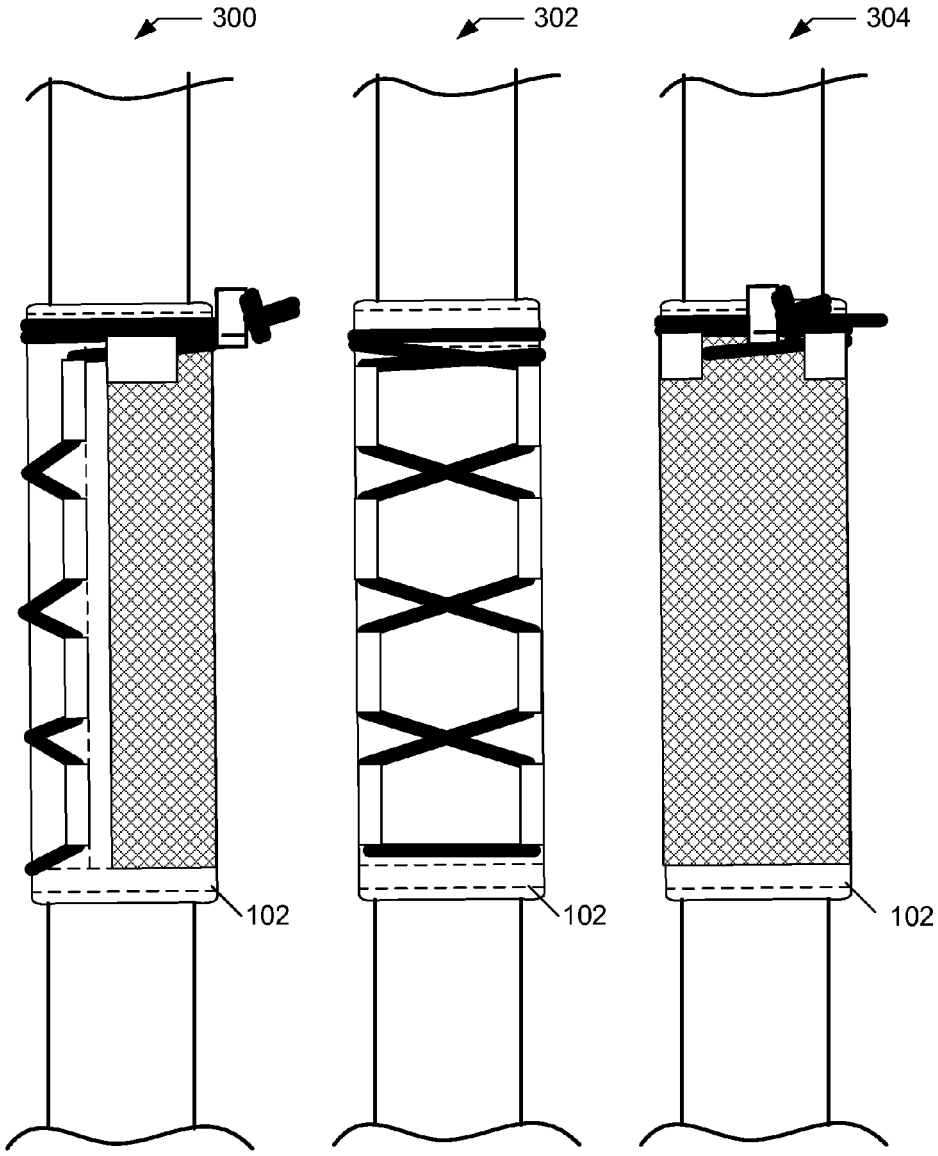
FIG. 3*a*-3*c* are example depictions of the TRPW of FIG. 1 placed around a barrel of a firearm in accordance with an example implementation.

Turning to FIG. 2, a depiction 200 of a TRPW 102 of FIG. 1 with securing means 104 and 106 in accordance with an example implementation of the invention. The securing means 104 and 106 in the current example is a cord and a lock respectively. The cord 104 is secured in a manner similar to a shoe lace that pulls the TRPW 102 in two directions and forms a cylinder. An advantage to using a cord and lock is the TRPW 102 may be adjusted for different style and/or sized firearm barrels. In other implemental, the securing means may be Velcro, elastic straps, snaps, ties, or any other approach that can cause the flat TRPW 102 of FIG. 1 to conform to a firearm barrel. In FIG. 3*a*-3*c*, example depictions 300, 302, and 304 of the TRPW 102 of FIG. 1 placed around a barrel of a firearm in accordance with an example implementation is shown.

Figure 4:
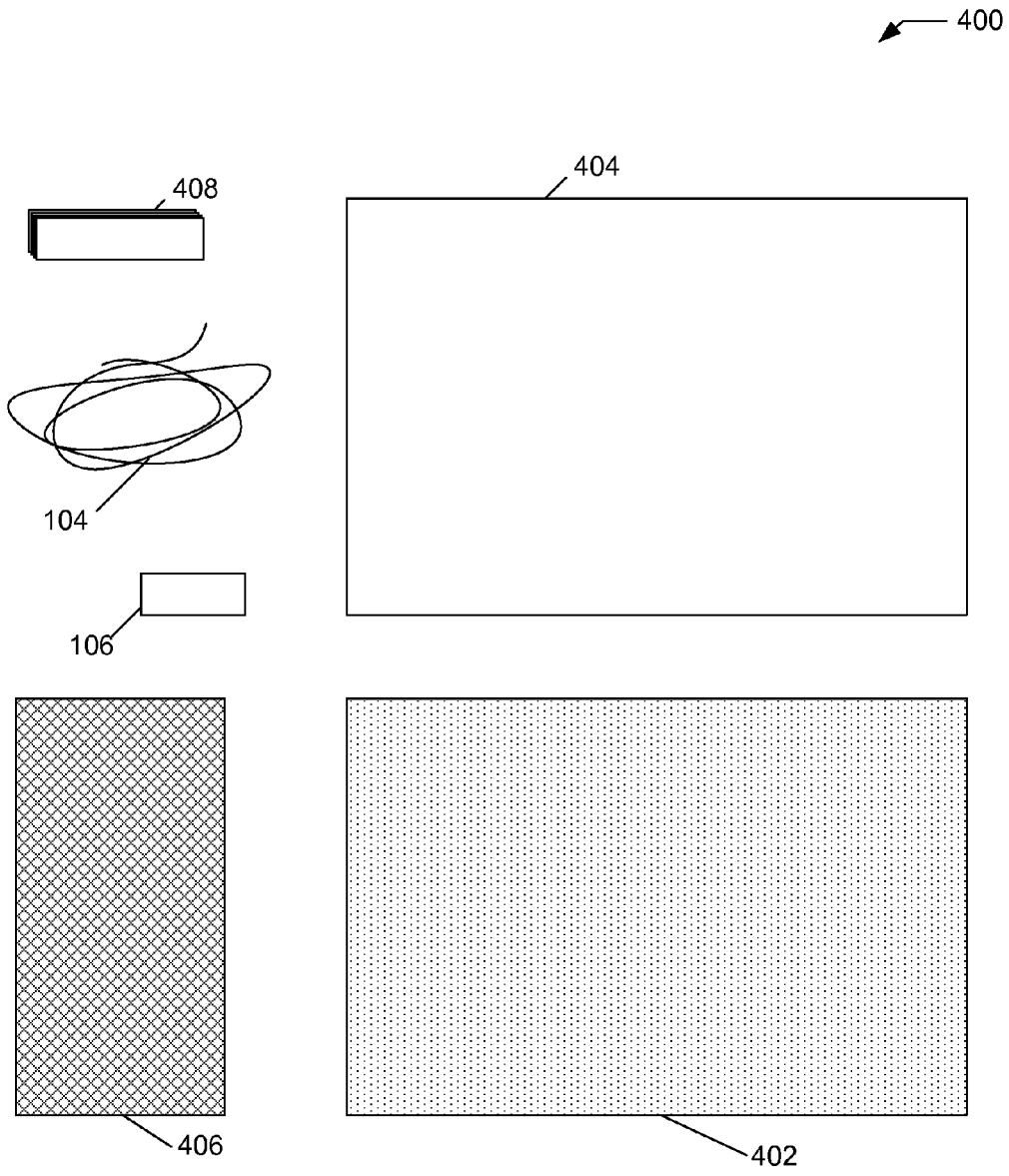
FIG. 4 is an example depiction of material that may be found in the TRPW of FIG. 1 in accordance with an example implementation.

Turning to FIG. 4 is an example diagram 400 of material that may be found in the TRPW 102 of FIG. 1 is depicted. A heat shield element 402, (i.e. heat shield felt fabric) is placed such that it is between the other layers of the TRPW 102 and the firearm barrel. A protective element 404 (COR- DURA™ or nylon fabric) is placed over the heat shield element. The protective element 404 protects the heat shield element 402 and may have decorative qualities (such as having a camouflage design). An additional non-slip element 406 (non-slip fabric) may be placed on the protective element 404 to provide additional gripping support. In other implementations, the non-slip element 406 may be integrated into or a characteristic of the protective element 404. Additional elements 408, such as webbing strips (loops), may be secured to the protective element 404 to enable the securing means 104 and 106 anchor points to secure the TRPW. The webbing strips may be secured to the protective element 404 by sewing, gluing, riveting, or other approaches that may secure multiple layers of fabric or materials together.

The heat shield element 402 may be a material that is flexible and reduces/prevents the flow of heat generated by a barrel of a firearm. In the current example a PAN-based carbon fiber with woven reinforcement is employed. The PAN-based carbon fiber material has a maximum temperature of 3000 degrees Fahrenheit with a service temperature of 1800 Fahrenheit. The thermal conductivity is 0.03 W/m*K with a weight of less than 22 oz. per square yard. The light weight material is also desirable as the resulting TRPW 102 has a minimum affect on the weight and balance of the firearm. In other implementations, other heat shield element 402 approaches may be employed, such as honeycomb or corrugated material.

Figure 5:
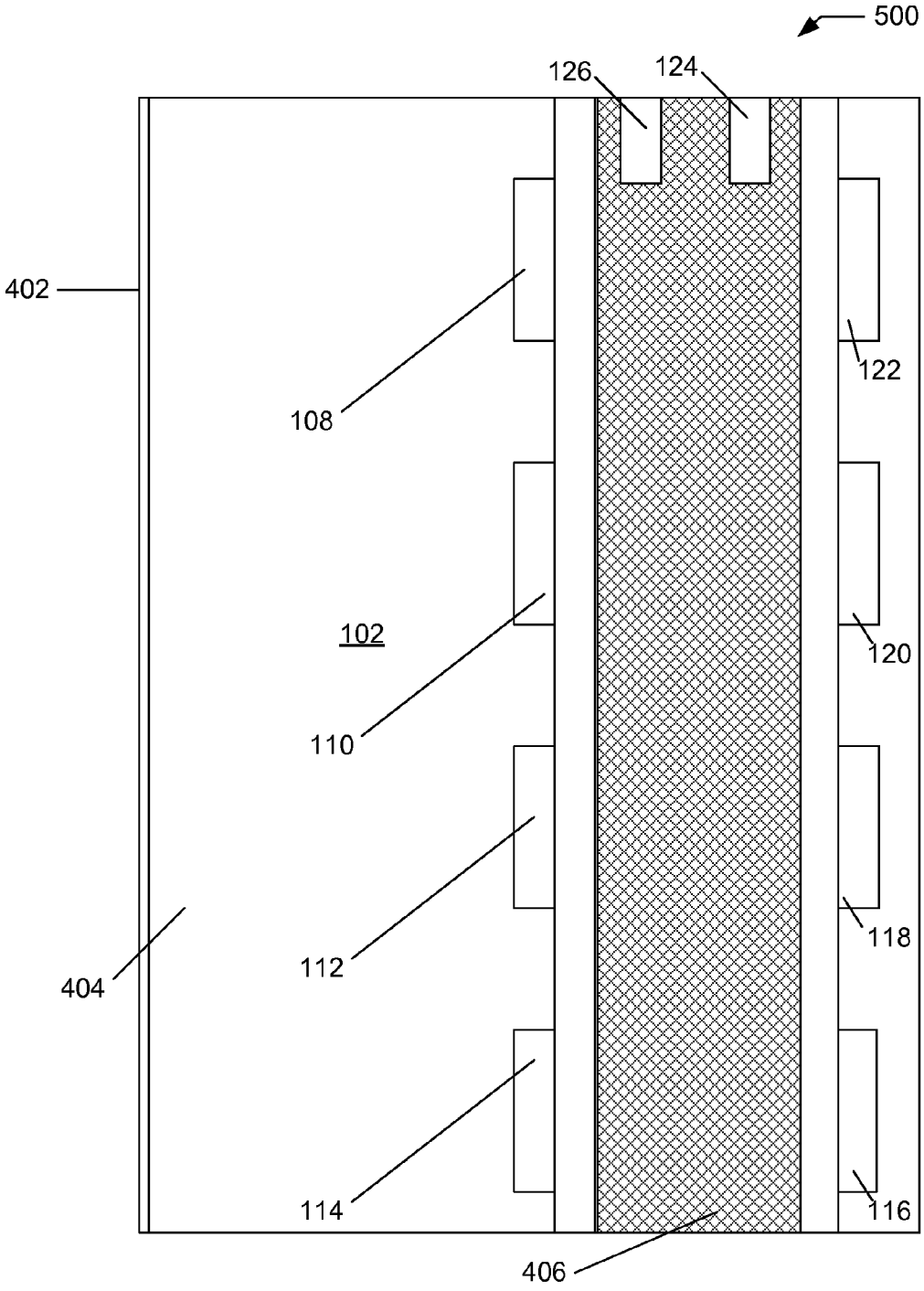
FIG. 5 is an example depiction of the different layers of the TRPW of FIG. 1 being integrated together in accordance with an example implementation.

In FIG. 5, a diagram 500 of the different layers 402 and 404 of the TRPW 102 of FIG. 1 being integrated together is depicted in accordance with an example implementation. In diagram 500, the integration is accomplished via sewing or stitching. In other implementations, gluing, riveting, or other securing approaches may be employed. In yet other implementations, the securing means may be integrated through all the different layers 402 and 404 and secure the different lays around the barrel of a firearm.

The foregoing detailed description of one or more embodiments of the TRPW 102 has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

The invention claimed is:

1. A temperature reduction protective wrap for a barrel of a firearm, comprising:

a heat shield element;

a protective element, where the heat shield element is integrated with the protective element;

a non-slip element secured to the protective element, the non-slip element having a perimeter where the protective element includes a first set of loops coupled to the perimeter and spaced apart across the protective element in parallel pairs and a second set of loops coupled to the perimeter and located perpendicular to at least one of the first set of loops towards one end of the protective element; and a securing means including a cord that may be passed through the loops and a locking member coupled to opposing ends of the cord, where the securing means is adapted to secure the heat shield element around the barrel of the firearm, and where the locking member locks the cord such that the cord remains tightened or stressed about the barrel of the firearm.

2. The temperature reduction protective wrap of claim 1, where the heat shield element is completely covered by the protective element.

3. The temperature reduction protective wrap of claim 1, where the heat shield element is a PAN-based carbon fiber material.

4. The temperature reduction protective wrap of claim 3, where the protective element has a camouflage pattern.

5. The temperature reduction protective wrap of claim 1, where the securing means includes a wire.

6. The temperature reduction protective wrap of claim 1, where the securing means includes a strip of fabric.

7. The temperature reduction protective wrap of claim 1, where the heat shield element has a thermal conductivity of no more than 0.03 W/m*K.

8. The temperature reduction protective wrap of claim 1, where the non-slip element covers only a portion of the protective element.

9. The temperature reduction protective wrap of claim 1, where the protective element is nylon fabric.

10. A temperature reduction protective wrap for a barrel of a firearm, comprising:

a heat shield element;

a protective element, where the protective element is more thermally conductive than the heat shield element, the protective element including a first set of loops and a second set of loops;

a non-slip element having a perimeter, where the heat shield element is integrated with the protective element with the non-slip element covering a portion of the protective element, and where the first set of loops are coupled to the perimeter and spaced apart across the protective element and the second set of loops are coupled to the perimeter and located perpendicular to at least one of the first set of loops towards one end of the protective element; and a securing means including a cord adapted to pass through the loops and a locking member coupled to opposing ends of the cord, where the securing means is adapted to secure the heat shield element around the barrel of the firearm, and where the locking member locks the cord at one end of the protective element proximate the second set of loops such that the cord remains tightened or stressed about the barrel.

11. The temperature reduction protective wrap of claim 1, where the locking member is coupled to the opposing ends of the cord at a location proximate the second set of loops.

* * * * *